United States Patent [19]

Doherty, III

[11] 4,197,020

[45] Apr. 8, 1980

[54] SPINNING PACK CONTAINING MIXING MEANS

[75] Inventor: Charles H. Doherty, III, Nashville, Tenn.

[73] Assignee: E. I. Du Pont de Nemours and Company, Wilmington, Del.

[21] Appl. No.: 310,953

[22] Filed: Nov. 30, 1972

[51] Int. Cl.[2] ..... B01F 15/02

[52] U.S. Cl. ..... 366/339; 425/198; 425/DIG. 49

[58] Field of Search ..... 425/131, 198, 464, DIG. 49; 366/339

[56] References Cited

U.S. PATENT DOCUMENTS

| | | | |
|---|---|---|---|
| 3,286,992 | 11/1966 | Armeniades et al. | 259/4 |
| 3,559,237 | 2/1971 | Biggelaai et al. | 425/131 |

*Primary Examiner*—Robert W. Jenkins

[57] ABSTRACT

A spinneret assembly that includes a filtration cavity and a spinneret has a plate between the cavity and spinneret. The plate has an enclosed channel connecting the cavity and spinneret. The channel contains a plurality of stationary mixing elements and lies in a plane substantially parallel with the spinneret.

3 Claims, 3 Drawing Figures

SPINNING PACK CONTAINING MIXING MEANS

BACKGROUND OF THE INVENTION

This invention concerns a spinneret assembly containing means for improving intra- and interfilament uniformity of spun yarns, more specifically it concerns the use of stationary mixing means for the polymer immediately above the spinneret plate.

Graves in U.S. Pat. No. 2,266,363 describes a screen pack assembly composed of a filter pack between a metering pump and a spinneret.

British Pat. No. 1,139,397 concerns a melt spinning apparatus wherein mixing elements are positioned in vertical bores which feed from a filter assembly into a storage volume above a spinneret plate.

An object of this invention is a novel, easily constructed spinneret assembly having a compact arrangement of mixing means located between the filtration cavity and the spinneret plate.

SUMMARY OF THE INVENTION

The invention is a spinneret assembly comprising filtration cavity and spinneret plate elements separated by two flat distribution plates having a grooved interface so as to form an enclosed channel therebetween, said channel containing a plurality of stationary mixing elements in the form of flow dividers, said channel lying in a substantially parallel planar relationship with respect to said spinneret plate while communicating at one end to said filtration cavity and at the other end to a distribution space above said spinneret plate.

DETAILED DESCRIPTION OF THE ILLUSTRATED EMBODIMENTS

Figure 1:
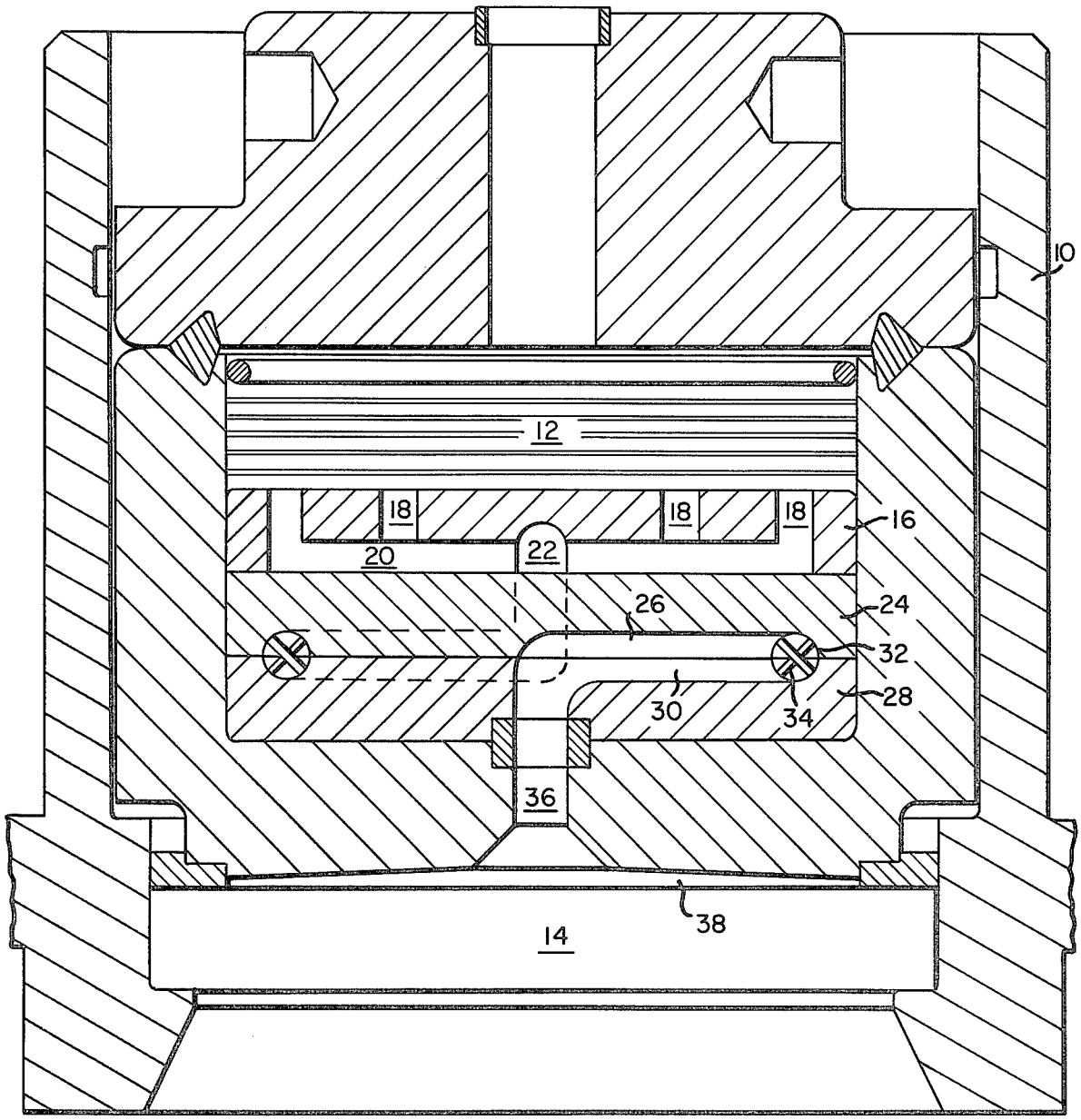
FIGS. 1 and 2 are sectioned elevation views of two embodiments of the spinneret pack assembly of this invention.

FIG. 1 shows spinneret pack assembly 10 having a filtration cavity 12 and spinneret plate 14, cavity 12 containing distribution plate 16 having a plurality of spaced orifices 18 connected by grooves 20 communicating via single channel 22 with channel plate 24. Plate 24 has a substantially circular groove 26 in its lower side matching with groove 30 in plate 28. Together, the grooves form circular channel 32 containing flow dividing, stationary, mixing elements 34 of the type described in U.S. Pat. No. 3,286,992. Channel 32 communicates via centrally located channel 36 with distribution space 38 above spinneret plate 14. Channel 32 is substantially circular with a substantially centrally located communicating outlet 36 and peripherally located feeding channel 22.

Figure 2:
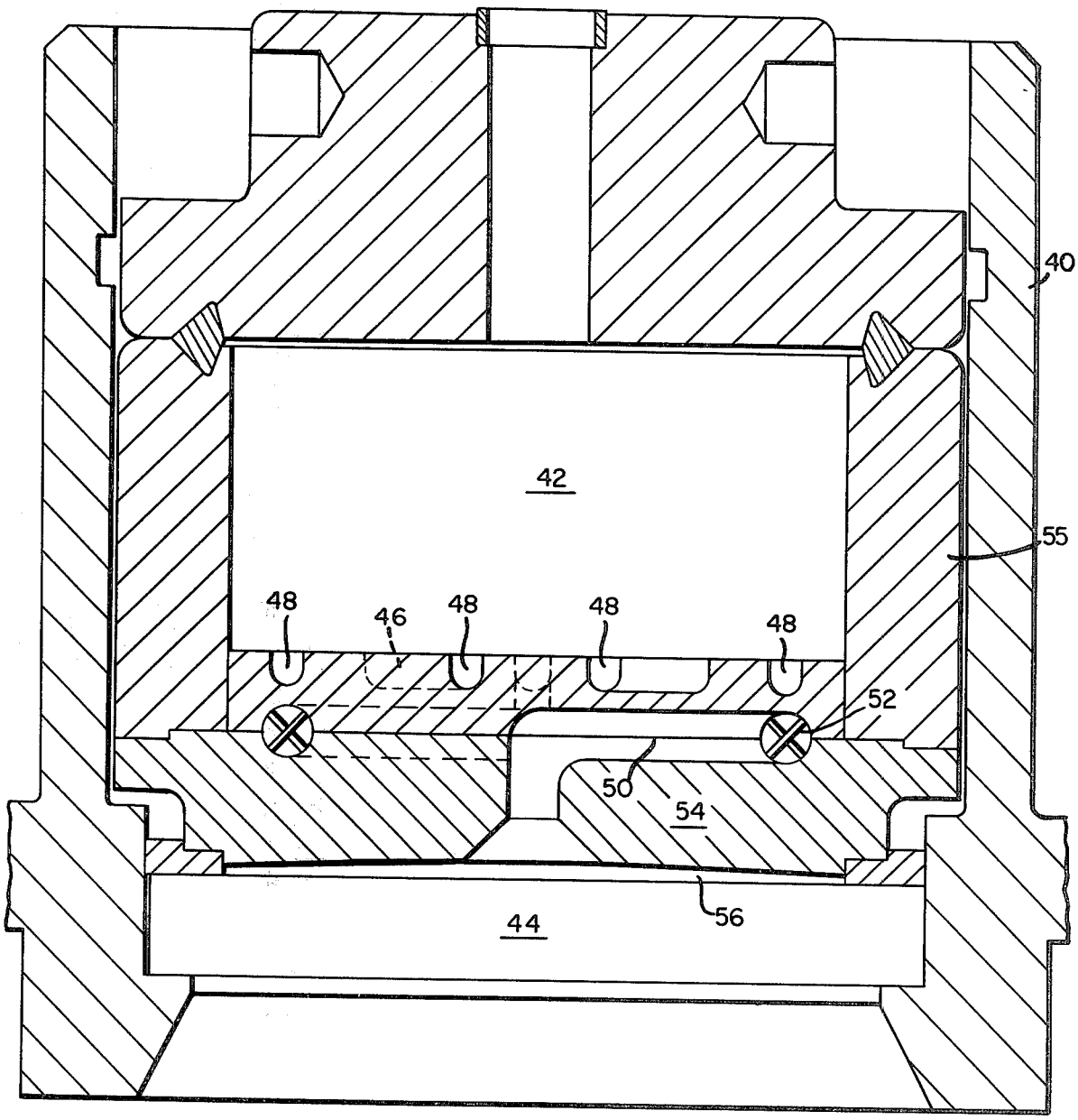

FIG. 2 shows a more compact arrangement with spinneret pack assembly 40 having filtration cavity 42 and spinneret plate 44; the bottom of cavity 42 being formed by integral feed distributor and channel enclosing plate 46 having distribution channels 48 communicating with enclosed channel 50 formed between plate 46 and plate 54 by matching grooves. Channel 50 contains mixer elements 52 and communicates with space 56 above spinneret plate 44. Plates 46 and 54 are brazed together and to the cylindrical body 55 forming filtration cavity 42, permanently sealing mixer elements 52 directly into the plate pack assembly.

The channel configuration may be of any suitable shape such as C-shaped, circular, spiral, folded, etc., or such a shaped series of geometrical chords each one-mixer-element long to avoid bending straight elements, and its cross-sectional configuration adapted to that of the mixing elements employed. The mixing elements may be contained within a tube which lies within the channel but preferably are contained directly between the two plates. The plates may be permanently fastened to one another, for example, by brazing. Particularly, suitable mixing elements are those described in U.S. Pat. No. 3,286,992.

Figure 3:
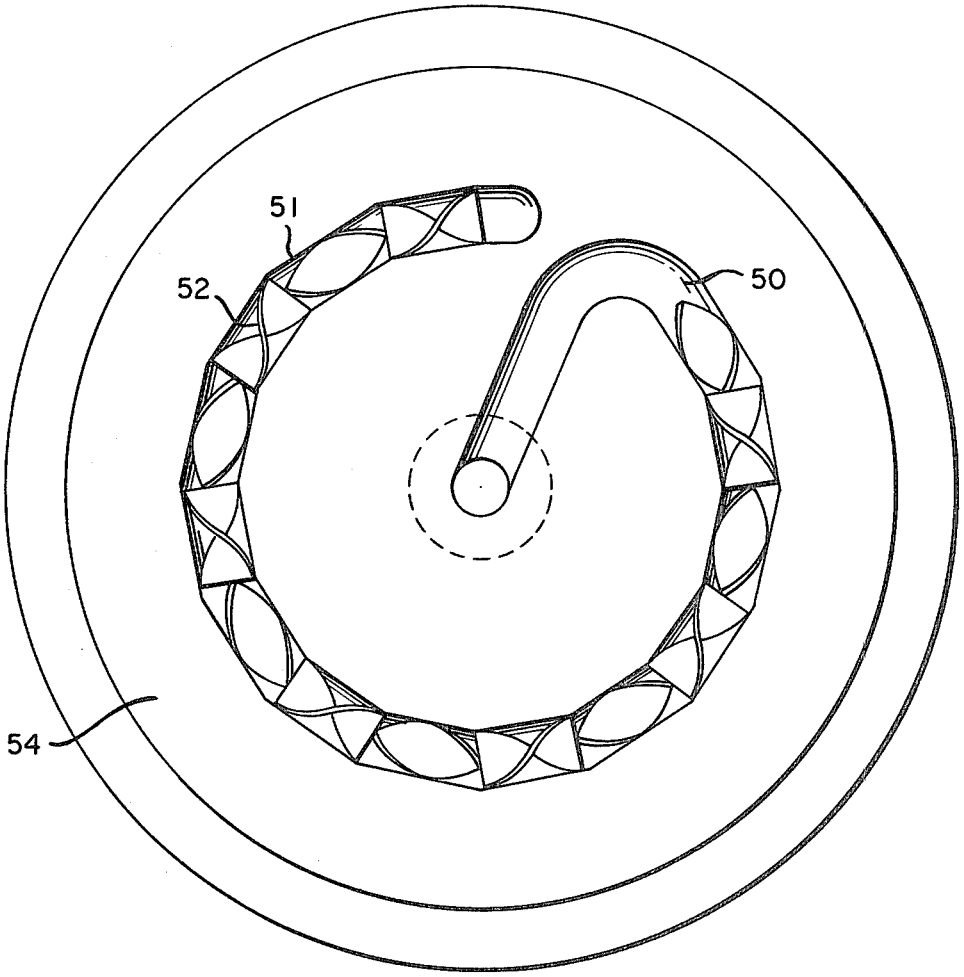
FIG. 3 is a top view of the bottom channel-containing plate element in FIG. 2 showing the channel configuration as a shaped series of geometrical chords.

Referring to FIG. 3, the most efficient way to accommodate a maximum number of mixer elements 52 in a circular channel without having to bend the elements, is to machine the channel 50 as a shaped series of geometrical chords 51 each one mixer element long with a mixer element 52 positioned along each of the chords.

Preferably, there is associated with the end of the channel communicating with the filtration cavity, a distribution plate for receiving polymer in a plurality of channels from points distributed evenly over the area from the filtration cavity and feeding it into said enclosed channel through a single orifice. The distribution plate may be a separate element positioned above the top channel plate or it may be incorporated into the top surface of the channel enclosing plate.

By having all of the polymer to the spinneret pass through a single mixing channel, the possibility of inhomogeneities arising from polymer or thermal differences from passing through several, separate mixing cores as shown in British Pat. No. 1,139,397 is avoided. This invention readily permits the use of a large number, e.g., 8–14, of mixing elements in series for greater mixing efficiency while occupying little space in the spinneret pack assembly. This permits inclusion of this invention within existing assemblies of the type described in U.S. Pat. Nos. 2,266,363 and 2,266,368 while still leaving adequate space for inclusion of filtration means without further position modifications.

What is claimed is:

1. In a spinneret assembly that includes a filtration cavity in communication with a spinneret, the improvement comprising: a plate positioned between said cavity and said spinneret, said plate having an enclosed channel in communication with said filtration cavity and said spinneret, said channel having a substantially circular configuration, a circular cross-section, and lying in a plane parallel with said spinneret; and a plurality of stationary mixing elements positioned in series in said channel, said enclosed channel having the configuration of a circular shaped series of geometrical chords each chord being one mixing element long, there being a mixing element positioned along each of said chords.

2. The spinneret assembly of claim 1, said plate being two flat distribution plates having a grooved interface, said interface forming said enclosed channel.

3. A mixer structure comprising:

a. an elongated conduit having inlet and outlet ports for the passage of fluid material;

b. said conduit being convoluted between said ports;

c. said conduit containing within it a plurality of curved sheet-like elements extending in series along said conduit and each such element having a curvature to rotate the material flowing through said conduit, the longitudinal axis of each element being substantially a straight line, said elements being arranged in alternating right and left-handed curvature groups with leading and trailing edges of adjacent elements being disposed at a substantial angle to each other;

d. said conduit being formed of a series of short sections of a straight cylinder, and each of said elements being mounted in one of said sections.

* * * * *